US005355998A

United States Patent [19]

Bienaime

[11] Patent Number: 5,355,998

[45] Date of Patent: Oct. 18, 1994

[54] PACKAGING FOR A PLURALITY OF CYLINDRICAL CONTAINERS CONCEALING ONLY A BOTTOM PORTION OF THE CONTAINERS

[75] Inventor: Patrick Bienaime, Milly sur Therain, France

[73] Assignee: 4P Emballages France, Beauvais Cedex, France

[21] Appl. No.: 78,421

[22] Filed: Jun. 16, 1993

[30] Foreign Application Priority Data

Jun. 16, 1992 [FR] France ..... 92 07269

[51] Int. Cl.[5] ..... B65D 5/06

[52] U.S. Cl. ..... 206/145; 206/427

[58] Field of Search ..... 206/427, 429, 431, 434, 206/139, 141, 145, 147, 148, 149

[56] References Cited

U.S. PATENT DOCUMENTS 4,451,001 5/1984 Webinger ..... 206/434 X
4,919,266 4/1990 McIntosh, Jr. et al. ..... 206/429 X
4,930,829 6/1990 Paulson ..... 206/427 X
5,060,792 10/1991 Olift ..... 206/434 X

*Primary Examiner*—Jacob K. Ackun, Jr.
*Attorney, Agent, or Firm*—Michael J. Striker

[57] ABSTRACT

Packaging of the tube type has a bottom wall (100) constituted by a single piece. In the bottom region of an end opening, a continuous skirting (101, 102) is hinged to the bottom and is connected laterally to adjacent portions of the packaging (300, 110) by flaps (103, 104) for holding the skirting in an upright position. At least one locking tab (410, 412) projects from an end edge of one of the walls (400) and includes a central portion (410) together with at least one wing (412). A locking opening (114) is provided in the opposite region of the blank, in the vicinity of a hinge (P3) between another main (100) and a locking flap (110). Each tab is inserted into a corresponding opening by temporarily deforming the associated wing(s). The invention is particularly suitable for providing the outer packaging of primary containers.

17 Claims, 2 Drawing Sheets

FIG_1
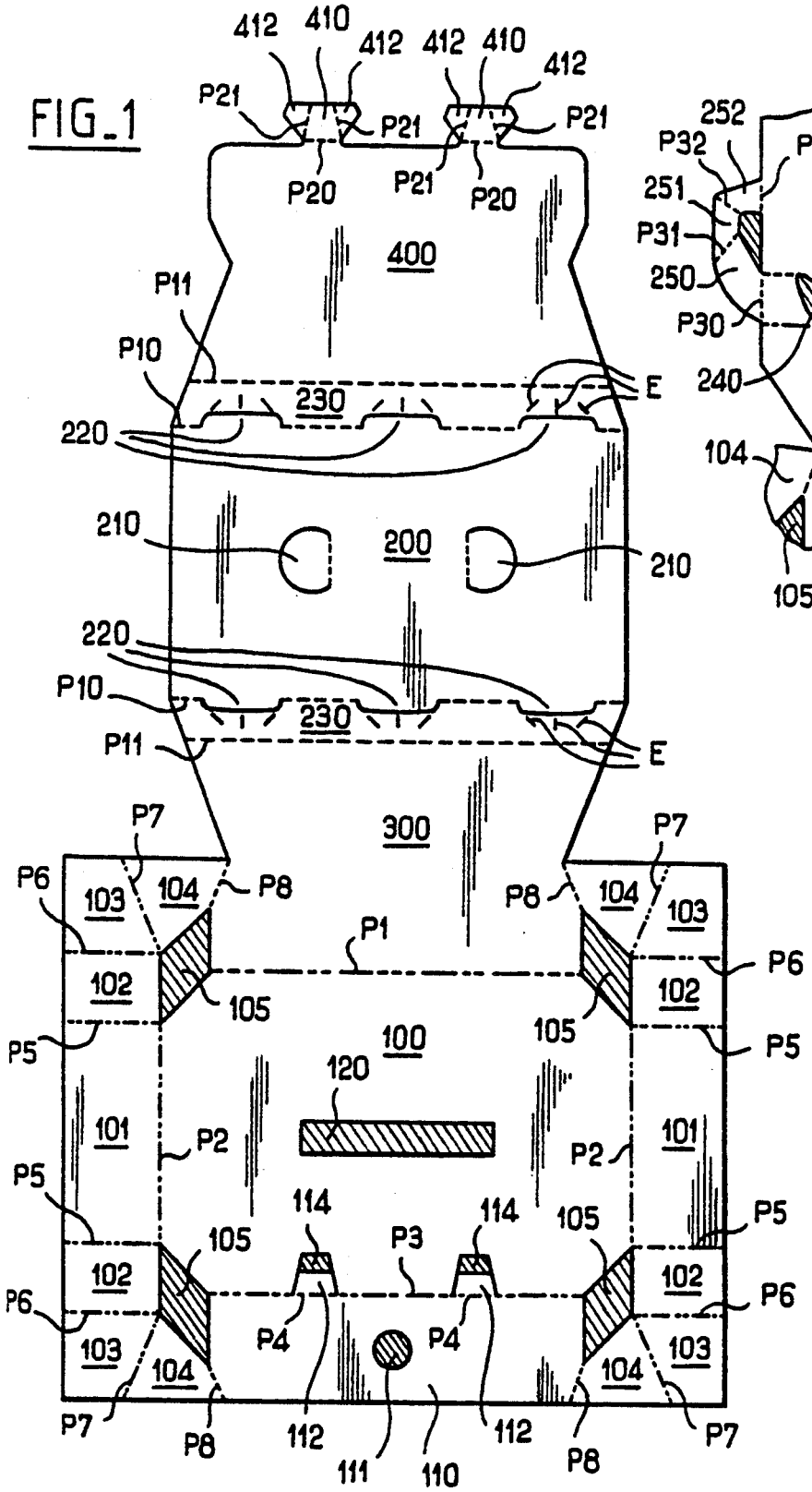
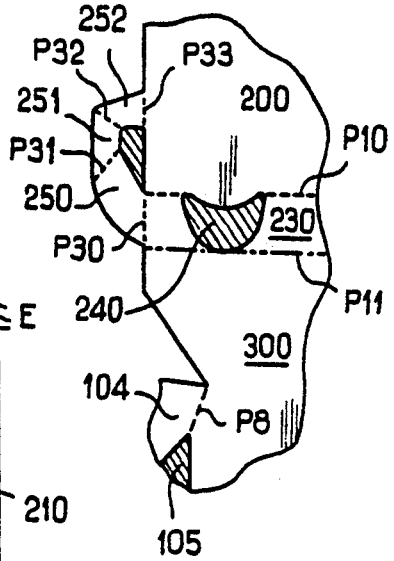
FIG_2

PACKAGING FOR A PLURALITY OF CYLINDRICAL CONTAINERS CONCEALING ONLY A BOTTOM PORTION OF THE CONTAINERS

BACKGROUND OF THE INVENTION

The present invention relates in general to tube type packaging of folded card or the like for holding together a plurality of objects such as primary containers, e.g. generally cylindrical beverage cans disposed in two parallel rows.

It frequently happens that articles such as primary containers include bar codes or the like in their own base regions identifying the individual contents. Simultaneously, the outer packaging also includes a different bar code identifying the product group as a whole. The bar code of each container is generally situated near the base thereof and that is why it is desirable to fit the outer packaging with axial end skirtings projecting upwards from its bottom wall in order to prevent accidental reading of the bar codes on the individual containers.

Simultaneously, such outer packaging is generally made by being looped back onto itself and by implementing adhesive or mechanical locking means. For reasons relating essentially to appearance, the glued flaps or the mechanical locking means are generally disposed in the bottom wall of the outer packaging, so as to leave the side and top surfaces of the outer packaging essentially smooth. Under such circumstances, the bottom wall is made up of two portions that are initially situated at two opposite ends of a starting blank.

It will be understood that it is difficult to make the above requirement compatible with providing the previous-described skirting, and in practice outer packaging that is locked or glued together at the bottom has a skirting that is either unattractive in appearance, or else that requires glue between the skirting and the side walls of the outer packaging, for example, which is undesirable from the point of view of mechanization.

SUMMARY OF THE INVENTION

The present invention seeks to mitigate these drawbacks of the prior art by providing packaging in which the skirtings are continuous and made without gluing, and in which the side walls and top walls are also continuous.

To this end, the present invention provides packaging for a group of cylindrical containers, e.g. cans, the packaging being of the type made from a single blank of foldable material and comprising main walls constituted by a top wall, two side walls, and a bottom wall. The packaging is characterized in that the bottom wall is constituted as a single piece. The packaging has, a continuous skirting hinged on the bottom wall in the vicinity of its two opposite ends, to portions of the packaging adjacent to the bottom wall by means of flaps, so that the provided skirting(s) is/are locked in a position that is substantially transverse to the plane of the bottom wall. The packaging includes locking means comprising at least one locking tab projecting from the region of a free edge of the blank corresponding to an end edge of a main wall of the packaging, with the, or each, tab including a central portion and at least one wing hinged to the central portion, and at least one locking opening associated with each tab and provided in the opposite region of the blank in the vicinity of a fold line corresponding to an end edge of the adjacent other main wall of the packaging, between said other main wall and a locking flap, each tab being inserted in its opening with temporary deformation of the associated wing(s).

BRIEF DESCRIPTION OF THE DRAWING

Other aspects, objects, and advantages of the present invention appear more clearly on reading the following detailed description of preferred embodiments thereof given by way of non-limiting example and made with reference to the accompanying drawings, in which:

FIG. 1 is a plan view of a card blank for making a first embodiment of outer packaging of the invention;

FIG. 2 is a plan view of a detail of a blank constituting a variant embodiment.

DESCRIPTION OF THE PREFERRED EMBODIMENTS

Figure 3:
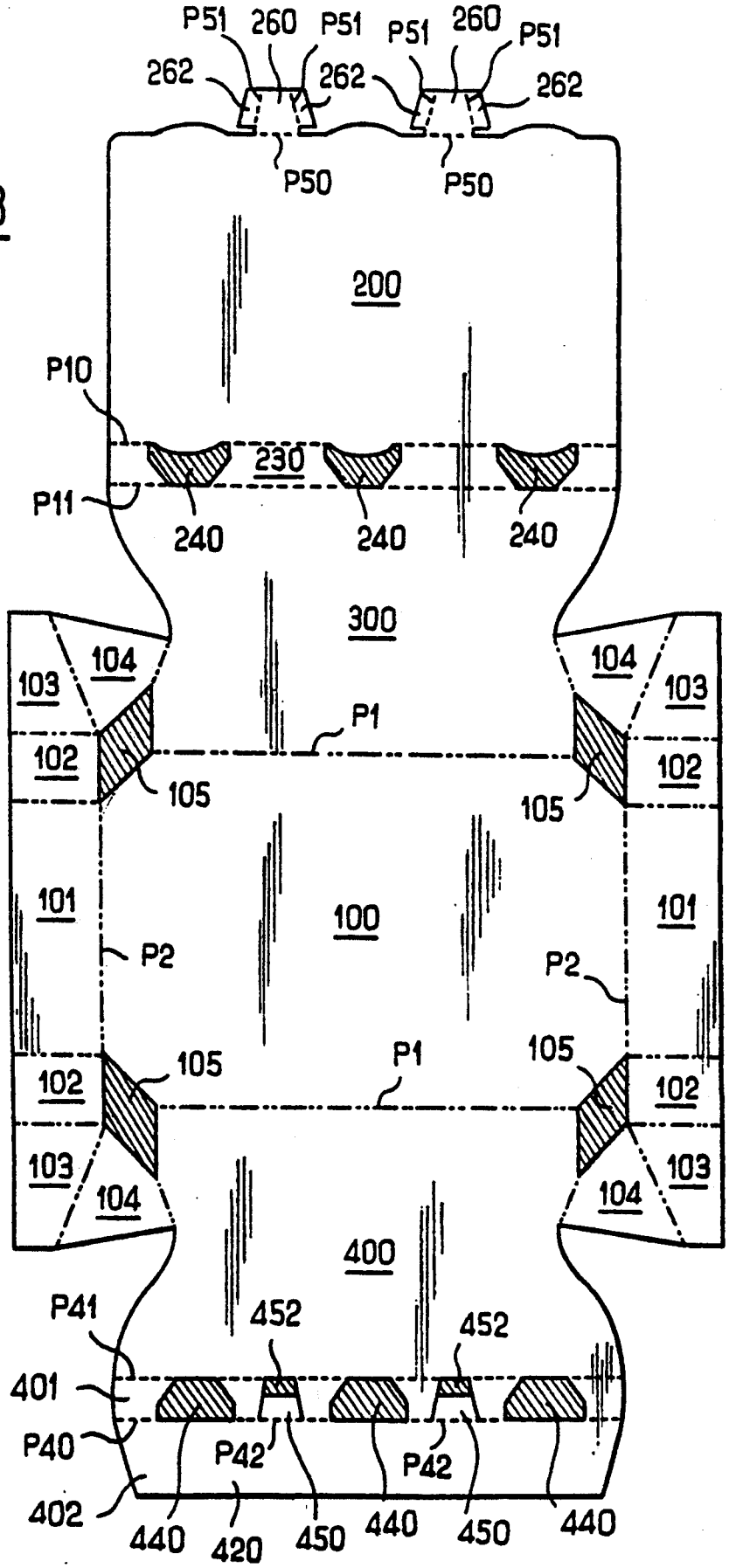
FIG. 3 is a plan view of a card blank for making a second embodiment of outer packaging of the invention.

Initially, it should be observed that in all of the figures, elements or portions that are identical or similar are generally designated by the same reference symbols. It should also be observed that cuts in the blanks shown are represented by solid lines, whereas fold lines (typically lines that are scored and/or notched) are represented by broken lines. Furthermore, portions of blank that are removed are represented by shading.

Finally, it should be observed that the shapes, proportions, and dimensions of the blanks shown in the figures are to be considered, wherever appropriate, as constituting an integral portion of the present description.

With reference initially to FIG. 1, there can be seen a blank for forming outer packaging for a group of six cylindrical containers such as beverage cans.

The blank mainly comprises four essentially rectangular zones, namely: a zone 100 forming the bottom wall of the outer packaging, a zone 200 forming the top wall, and two zones 300 and 400 forming two side walls. Between its two ends, the blank has the following zones in succession: 100, 300, 200 and 400.

A fold line P1 connects the bottom zone 100 to the side zone 300. Another fold line P3 connects the zone 100 to a flap 110 whose role is explained below. It may be observed that the flap 110 has a circular opening 111 in a central region thereof. The purpose of this opening is to facilitate the penetration of air between a blank that is being taken from a stack of such blanks by means of a conventional suction cup mechanism and the blank immediately beneath it, for the purpose of avoiding the well-known problem of a plurality of such blanks being taken together. Naturally, a plurality of such openings 111 could be provided.

It can also be seen in FIG. 1 that the bottom wall 100 has an essentially central elongate rectangular cutout 120 which determines a displacement direction for the blank prior to it being shaped in an automated packaging installation. More precisely, drive fingers can penetrate into the cutout 120 to entrain the blank, thereby making it possible to reduce the pitch size of the packaging. Thus, for production at a fixed rate, it is possible to reduce the linear speed of the shaping mechanisms.

In addition, when different packaging is provided for different numbers of containers, the cutout 120 may be provided in a position that is selected so that the distance between its rear edge (in the blank travel direction) and the adjacent fold line P2 is the same. The same machine can then accept different types of packaging without requiring adjustments to be changed in the mechanism for driving the blanks prior to shaping.

The top zone 200 is connected to the side zones 300 and 400 respectively by two intermediate zones 230 designed to take up a sloping inclination during shaping. A fold line P11 separates each intermediate zone 230 from the adjacent lateral zone 300 or 400, and another fold line P10, parallel to P11, connects each intermediate zone 230 to the top zone 200. Notches 220 are provided along these fold lines P10, e.g. in the form of circular arcs or of half-ellipses, thereby extending the top zone 200 outwardly a little relative to said fold lines P10. These notches, in combination with groups of straight notches E formed facing them in the adjacent intermediate portion serve to lock the top region of each container in position by deforming the material of the blank outwardly in the region of said straight notches.

It may be observed here that the edges of the material constituting the zones 230 defined by the notches 220 are designed to lock under the crimping rims conventionally provided around the periphery of cylindrical metal beverage containers. In this way, when the packaging is grasped from above, the zones 230 and the side walls 300 and 400 of the packaging contribute to supporting the weight of the containers without putting too much stress on the latches which close the packaging together.

Finally, two essentially circular pieces 210 are formed in the central region of the top zone 200 and are hinged to said zone 200 by fold lines so as to make it possible to carry the set of containers held together by the tube by inserting two fingers into the openings left by the pieces once they have been pushed in by said fingers.

On either side of the zone 100, arrangements of foldable flaps are provided for the purpose of forming two vertically oriented transverse skirtings at the axiel ends of the outer packaging when it is shaped. More precisely, each skirting comprises a main central portion 101 hinged to the zone 100 by a fold line P2 and designed to form a right angle with said zone 100, together with two side portions 102 that are designed to be sloped inwards at about 45° relative to the portion 101 so as to form transitions between the portion 101 and the side walls 300 and 110 of the tube while fitting closely over a generator line of the generally round-shaped containers.

Fold lines P5 extending parallel to P1 and P3 serve to connect the portions 101 to the portions 102.

The tube is shaped by lateral support flaps 103 and 104, each flap 103 being hinged to the associated portion 102 along a fold line P6 parallel to P5, and each flap 104 being hinged firstly to the flap 103 by a fold line P7 that may be at an inclination of about 60° to 80° relative to the line P6, for example, and that meets it at its inner end, and secondly to the side wall 300 or the flap 110 via a fold line P8 which may be inclined at about 100° to 120° relative to said line P6, for example. Each group constituted by a lateral skirting portion 102 and by the associated flaps 103 and 104 is also associated with an opening 105, which is generally lozenge-shaped in the present example, and which is defined by an inside edge of the portion 102, an inside edge of the portion 104, and outside edge of the side wall 300 or of the flap 110, and finally a chamfered edge situated in a corner of the bottom 100. Once the outer packaging has been shaped, the chamfered edge is designed to run along the base of the inclined skirting portion 102.

The skirtings are shaped, for example, by progressively folding the central portions 101 of the skirtings upwards relative to the bottom 100 about the fold lines P2 until an angle equal to or slightly less than 90° has been reached, while simultaneously exerting appropriate upward force in the vicinity of the four sets of flaps 103, 104 to ensure that during said folding the flaps penetrate into the inside volume of the tube that is being shaped. In a manner that is offset in time to a greater or lesser extent, but that preferably involves continuous motion, the side wall 300 and the flap 110 are then progressively folded to reach an angle of about 90°, with said motion entraining each of the flaps 104 in such a manner that the side wall 300 or the flap 110, the flap 103, and the flap 104 all extend in planes that are adjacent and substantially parallel, with the fold lines P7 and P8 being folded through about 180°. Each skirting is thus held in a position that is approximately perpendicular to the bottom 100. It may be observed that with the containers already in place on the bottom zone 100, each set of flaps 103 and 104 is relatively tightly engaged between the wall 300 or the flap 110 and an adjacent container, with this having the effect of practically locking the skirtings in place and consequently locking the primary containers in their respective positions.

It may be observed at this point that the skirtings could, in a variant, be shaped after the wall 300 and the flap 110 have begun to be folded, with the central portions 101 of the skirtings being folded upwards relative to the bottom 100 simultaneously with the region of the flaps 103 and 104 being subjected to inwards thrust as described above. Under such circumstances, the containers are not put into place until later.

It will be understood that implementing continuous end skirtings in the manner described above without gluing but merely by applying a small set of external forces for folding purposes is difficult to make compatible with fastening together the tube in the central region of its bottom wall.

Thus, in combination with the skirting structure as described above, the blank of FIG. 1 includes mechanical locking means that operate in the vicinity of one of the edges of the tube. More precisely, in the present example, the free end edge of side zone 400 that is at a distance from the top zone 200 has, in this case, two projecting locking tabs which are hinged to said zone 400 by fold lines P20 situated in line with the above-mentioned free edge, each tab comprising a generally trapezium-shaped central portion that tapers towards the outside and two lateral portions 412 that are hinged to said central portion by fold lines P21. These lateral portions or wings 412 are generally triangular in the present example, but their outer corners have nevertheless been cut off.

These tabs are designed to co-operate with corresponding arrangements provided in the region of the transition between the bottom 100 and its flap 110. More precisely, two trapezium-shaped openings 114 are provided in the region of the bottom adjacent to the fold line P3, and the dimensions of the openings are substantially identical to the dimensions of the central portions 410 of the above-described projecting tabs, the bases of said openings being in line with fold line P3.

Optionally, and as shown, a generally trapezium-shaped tab 112 extends some of the way into each opening from a fold line P4 that is in alignment with the fold line P3 for purposes that are explained below.

There follows a description of how the tube is locked together by means of the arrangements described above: in a final stage during which the blank is being folded along lines P1, P3, P10, and P11 to give it the shape of a tube that surrounds the installed containers, the free edge of the zone 400 is to be found in the vicinity of and parallel with the fold line P3 between the bottom zone 100 and the flap 110. The locking tabs 410 and 412 are then folded at substantially 90° beneath the bottom so that their central portions 410 overlie the openings 114 which are still partially closed by the tabs 112. Force is then exerted on said central portions which causes their lateral portions 412 to be folded outwardly around fold lines P21 simultaneously with the tabs 112 being folded inwardly around the lines P4 as each central portion 410 penetrates into the associated opening 114. When each of the tabs 410 and 412 has passed right through the opening 114, its lateral portions 412 tend by elasticity to return to a position where they are less inclined relative to the plane of the central portion 410 from which they depend, such that each tab 410 and 412 again becomes wider than the opening 114 and is thus locked behind said opening.

It may be observed at this point that each opening 114 opens out to the inside of the tube in an empty space between two adjacent cylindrical containers, thereby making it possible for the associated locking tab 410 or 412 to penetrate therein. During this penetration motion, the containers already in place in the tube constrain the motion of the lateral portions 410 of the locking tabs such that once in its final position, a tab cannot be flat in profile which would attenuate the strength of the locking effect, but retains a profile that is generally U-shaped, while the lateral portions 412 remain pressed against the inside surface of the bottom zone 100, thereby, on the contrary, reinforcing the strength of the locking effect.

It may be observed at this point that the flap 110 is provided firstly to make it possible to lock the outer packaging along the fold lines P4 and secondly to participate in the shaping of the skirtings 101 and 102 while it is being folded to 90° relative to the bottom.

It may also be observed that the locking of the tube by means of the tabs 410 and 412 and of the openings 114 provided with their own tabs 112 is such that the portions of card to be connected together co-operate, in the event of traction being applied, not via the sharp edges of the card which would run the risk of starting a tear if traction should become excessive, but via two folded zones (tab 112 and flap 110 on one side and tab portion 410 and side wall 400 on the other) which are engaged one within the other. This imparts entirely satisfactory mechanical strength to the locking.

FIG. 2 shows a variant embodiment of the blank shown in FIG. 1, and in which a gusset is also provided in each of the two top corners of each end opening of the final tube. Each gusset 250 is hinged on the adjacent intermediate zone 230 about a fold line P30 which is preferably situated in line with the free edges of the adjacent zones 300 and 200 (or 400 and 200), and each gusset is associated with two flaps 251 and 252, flaps 251 being hinged to the gusset opposite to fold line P30 along an inclined fold line P31, while the flap 252 is hinged firstly to the flap 251 about an inclined fold line 252 and secondly to the top wall 200 about a fold line P33 which is in alignment with the free edge of said wall 200.

An opening (not referenced) is defined by the bottom edges of the portion forming the gusset 250 and the flaps 251 and 252, and by an outer edge of the top zone 200.

While the blank is being shaped, the flaps 251 and 252 are urged inwards so as to extend substantially parallel to the plane of the zone 200, on the inside thereof, with the shapes of said flaps being such that the gusset occupies the corresponding corner of the end opening of the outer packaging, being at a substantial angle of inclination both relative to the plane of the top wall 200 and relative to the plane of the adjacent side wall 300 or 400.

It can also be seen in FIG. 2 that the notches 220 provided in the embodiment of FIG. 1 have been replaced by generally crescent-shaped openings 240 through which the top regions of the containers are designed to project.

A second basic embodiment of the present invention is described below with reference to FIG. 3.

The arrangements for forming the two end skirtings in association with the bottom 100 are not described again, since the corresponding zones, flaps, and fold lines are designated by the same reference symbols.

In the example of FIG. 3, the blank comprises in succession and between its two ends, the main zones 400, 100, 300, and 200, said zones having the same functions as the zones with the same reference numerals in FIG. 1.

Intermediate zones 230 and 401 are also provided, but instead of the notches 220, they include generally crescent-shaped openings 240 for receiving projecting top portions of the containers in order to hold them in place, in conventional manner.

The tube is locked together in the same way as described with reference to FIG. 1, except insofar as the locking tabs are provided in the free edge region of the top zone 200 and the corresponding openings are provided in the opposite intermediate zone which is designated by reference 401 and whose general outlines are identical to those of the intermediate portion 230. On the side of said intermediate zone 401 opposite from the side wall 400 there is a flap 402 which performs the same function as the flap 110 of FIG. 1 when it comes to locking purposes.

Each locking tab is likewise provided with a central portion referenced 260 and two side wings referenced 262. The wings 262 are different in shape from the wings 412 of FIG. 1, since the wings 242 are parallelogram-shaped.

In this case, the openings 452 extend over the entire width of the intermediate zone 401, each having a trapezium shape that is substantially identical to that of the central portion 260 of the tabs.

As in the case shown in FIG. 1, a tab 450 hinged on a fold line P42 in alignment with the fold line P41 separating the intermediate zone 401 from the adjacent flap 402 occupies, prior to locking, a fraction of the area of the opening 452.

The fold line between the intermediate portion 401 and the side zone 400 is designated P41.

The blank shown in FIG. 3 is shaped in the same manner as the blank shown in FIG. 1 when shaping the skirting, except insofar as it is now the side zone 400 which performs the function previously performed by the flap 110.

As for locking, it is the flap 402 that performs the role that was previously performed by the flap 110.

Finally, it may be observed that the openings 440 formed in the intermediate zone 401 for the top regions of the containers are of a shape that differs from that of the openings 240 formed in the other intermediate zone 230 in that their edges adjacent to the top wall 400 after shaping are rounded, whereas the corresponding edges of each of the openings 440 are straight. The overlap portion at the curved edge is defined in this case by appropriately shaping the edge of the top wall 200 from which the tabs 260 and 262 project.

Naturally, the present invention is not limited in any way to the particular embodiments described above and shown in the drawings, and the person skilled in the art will be able to make variations and changes within the ambit of the invention. In particular, the person skilled in the art will be able to adapt the shape and the dimension of the outer packaging of the invention to varying numbers, dispositions, and shapes of packaged articles.

I claim:

1. Packaging for a plurality of cylindrical containers, said packaging being made from a single blank of foldable material and comprising:

a bottom wall (100);

a top wall (200);

a side wall (300) hingedly connecting said top wall (200) to said bottom wall (100);

another side wall (400) hingedly connected to said top wall (200) on a longitudinal side of said top wall opposite to said side wall (300);

a continuous skirting (101,102) hingedly connected to said bottom wall (100) on opposite ends of said bottom wall (100);

a locking flap (110) hingedly connected to a fold line (P3) corresponding to a longitudinal side edge of said bottom wall (100) opposite from another longitudinal side edge of said bottom wall (100) connected to said side wall (300);

lateral support flaps (103,104) hingedly connecting said side wall (300) and said continuous skirting (101,102) at each of said opposite ends of said bottom wall (100) and other lateral support flaps (103,104) hingedly connecting said locking flap (110) to said continuous skirting (101,102) at each of said opposite ends of said bottom wall (100), said lateral support flaps being formed so as to be foldable to fix said continuous skirting (101,102) at each of said opposite ends of said bottom wall (100) in a position substantially transverse to a plane of said bottom wall so that said packaging can enclose a group of containers with said continuous skirting covering bottom end portions of said containers; and means for locking said other side wall (400) with a longitudinal side of said bottom wall (100) opposite to said side wall (300), said means for locking including at least one locking tab (410,412) projecting from the vicinity of a free longitudinal side edge of said other side wall (400) and at least one locking opening (114) associated with each of said at least one locking tab (410,412) and provided in said bottom wall (100) in the vicinity of said fold line (P3) corresponding to said side edge of said bottom wall (100) opposite from said other side edge of said bottom wall (100) and located between said bottom wall (100) and said locking flap (110), each of said at least one locking tabs including a central portion (410) and at least one wing (412) hingedly connected to said central portion so that each of said at least one locking tabs can be locked in a corresponding one of said at least one locking openings by temporary deformation of said at least one wing of said at least one locking tab.

2. Packaging as defined in claim 1, further comprising a reinforcing tab (112) provided partially obstructing said at least one locking opening (114) and formed so that a fold line (P20) of said blank between said at least one locking tab and said other side wall (400) can be positioned adjacent a fold line (P4) of said blank located between said locking flap (110) and said reinforcing tabs (112).

3. Packaging as defined in claim 2, wherein each of said reinforcing tabs (112) is hingedly connected to said locking flap along a longitudinal edge of said at least one locking opening, said longitudinal edge being coincident with said fold line (P4) between said locking flap (110) and said bottom wall (100).

4. Packaging as defined in claim 2, wherein said at least one locking opening, said reinforcing tabs and said central portion of said at least one locking tab are trapezium-shaped.

5. Packaging as defined in claim 2, wherein said at least one locking tab is hingedly connected to said free longitudinal side edge of said other side wall (400).

6. Packaging as defined in claim 5, wherein said at least one locking opening has an edge coincident with said fold line (P3) corresponding to said side edge of said bottom wall (100) opposite from said other side edge of said bottom wall (100) connected to said side wall (300).

7. Packaging as defined in claim 6, wherein said at least one locking tab includes two of said wings on opposite sides of said central portion and is shaped and dimensioned so as to have an approximately U-shape and width greater than that of said locking opening associated therewith.

8. Packaging as defined in claim 1, wherein said locking flap (110) is provided with at least one opening (111) for facilitating separation of said blank from a stack of blanks.

9. Packaging as defined in claim 1, wherein said bottom wall (100) is provided with an elongate opening (120) for shaping purposes.

10. Packaging as define in claim 9, wherein a distance between said elongate opening (120) and one of two end edges of said bottom wall (200) equals a distance between said elongate opening (120) equals a distance between said elongate opening (120) and said fold line (P3) corresponding to said side edge of said bottom wall opposite from said other side edge of said bottom wall connected to said side wall.

11. Packaging for a plurality of cylindrical containers, said packaging being made from a single blank of foldable material and comprising:

a bottom wall (100);

a top wall (200);

a side wall (300) hingedly connecting said top wall (200) to said bottom wall (100);

another side wall (400) hingedly connected to said bottom wall (100) on a longitudinal side opposite to said side wall (300);

a continuous skirting (101,102) hingedly connected to said bottom wall (100) on opposite ends of said bottom wall (100);

a locking flap (402) hingedly connected to a fold line (P42) corresponding to a longitudinal side edge of said other side wall (400) opposite from another longitudinal side edge of said other side wall (400) connected to said bottom wall (100);

lateral support flaps (103,104) hingedly connecting said side wall (300) to said continuous skirting (101, 102) at each of said opposite ends of said bottom wall (100) and other lateral support flaps (103,104) connecting said other side wall (400) to said continuous skirting (101,102) at each of said opposite ends of said bottom wall (100), said lateral support flaps being formed so as to be foldable to fix said continuous skirting (101,102) in a position substantially transverse to a plane of said bottom wall so that said packaging can enclose a group of containers with said continuous skirting covering bottom end portions of said containers; and means for locking said top wall (200) with a longitudinal side of said other side wall (400), said means for locking including at least one locking tab (260,262) projecting from the vicinity of a free longitudinal side edge of said top wall (200) and at least one locking opening (452) associated with each of said at least one locking tab (260,262) and provided in said other side wall (400) in the vicinity of said fold line (P42) corresponding to said longitudinal side edge of said other side wall (400) opposite from said other longitudinal side edge of said other side wall (400) and located between said other side wall (400) and said locking flap (402), each of said at least one locking tabs including a central portion (260) and at least one wing (262) hingedly connected to said central portion so that each of said at least one locking tabs can be locked in a corresponding one of said at least one locking openings by temporary deformation of said at least one wing of said at least one locking tab.

12. Packaging as defined in claim 11, further comprising a reinforcing tab (450) provided partially obstructing said at least one locking opening (452) and formed so that a fold line (P50) of said blank between said at least one locking tab and said side wall (200) can be positioned adjacent a fold line (P42) of said blank located between said locking flap (420) and said reinforcing tabs (450) of said at least one locking opening (452).

13. Packaging as defined in claim 12, wherein each of said reinforcing tabs (450) is hingedly connected along a longitudinal edge of said at least one locking opening provided with said reinforcing tab, said longitudinal edge being coincident with said fold line (P42) between said locking flap (420) and said other side wall (400).

14. Packaging as defined in claim 12, wherein said at least one locking opening, said reinforcing tabs and said central portion of said at least one locking tab are trapezium-shaped.

15. Packaging as defined in claim 12, wherein said at least one locking tab is hingedly connected to said free longitudinal side edge of said top wall (200).

16. Packaging as defined in claim 15, wherein said at least one locking opening has an edge coincident with said fold line (P42) corresponding to said longitudinal side edge of said other side wall (400) opposite from said other longitudinal side edge of said other side wall (400) connected to said bottom wall (100).

17. Packaging as defined in claim 16, wherein said at least one locking tab includes two of said wings on opposite sides of said central portion and is shaped and dimensioned so as to have an approximately U-shape and width greater than that of said locking opening associated therewith.

* * * * *